US006309332B1

(12) United States Patent
Hao

(10) Patent No.: US 6,309,332 B1
(45) Date of Patent: Oct. 30, 2001

(54) TOUCH COUNTER FOR AN EXERCISE DEVICE

(76) Inventor: Kuo-Wu Hao, No. 435-8, Pei-Tun Rd., Taichung (TW)

( * ) Notice: Subject to any disclaimer, the term of this patent is extended or adjusted under 35 U.S.C. 154(b) by 0 days.

(21) Appl. No.: 09/572,148

(22) Filed: May 17, 2000

(51) Int. Cl.[7] ..... A61B 1/00

(52) U.S. Cl. ..... 482/148; 374/208

(58) Field of Search ..... 374/208, 183; 482/148

(56) References Cited

U.S. PATENT DOCUMENTS 4,741,627 * 5/1988 Fukui et al. ..... 374/208

* cited by examiner

*Primary Examiner*—Glenn E. Richman
(74) *Attorney, Agent, or Firm*—William E. Pelton

(57) ABSTRACT

A touch counter for an exercise device has a base and a movable cover. A cavity is defined along the length of the base. At least one post extends upwards from the bottom of the cavity. The movable cover is pivotally mounted in the cavity and has a circuit board and at least one switch. The display is mounted under the movable cover. The circuit board is mounted under the display. The switches are located under the movable cover and correspond to the posts.

9 Claims, 6 Drawing Sheets

TOUCH COUNTER FOR AN EXERCISE DEVICE

BACKGROUND OF THE INVENTION

1. Field of the Invention

The present invention relates to a touch counter for an exercise device, and particularly, to a touch counter for an exercise device, which can change the display of the counter by touching it and costs less to manufacture the counter.

2. Description of Related Art

With reference to FIG. 6, the conventional counter for an exercise device comprises a cover (30), a display (31) located in the cover (30), one or more openings (32) defined in the cover (30) and a pushbutton (40) exposed through each opening (32). A number of problems exist with the conventional counter for an exercise device.

(a) First, the steps to manufacture the counter are complicated, which results in a high manufacturing cost:

The conventional counter needs at least two molds to fabricate the cover and the moveable buttons. The buttons and cover may be made of different materials.

(b) Touching a specific button is not convenient:

When the user is exercising, the user is moving and the exercise device will continuously shake rendering it difficult to touch the correct button without interrupting the exercise.

In view of the foregoing, a touch counter for an exercise device is desired, which can change the display of the counter by touching the counter and costs less to manufacture.

SUMMARY OF THE INVENTION

The objective of the present invention is to provide a touch counter for an exercise device, which can change the display of the counter by touching counter and costs less to manufacture.

To achieve the objective, the touch counter for an exercise device in accordance with the present invention comprises a base and a movable cover. The base has a cavity define along the length of the base and at least one post extending upwards from the cavity. The movable cover is pivotally mounted in the cavity and has a display, a circuit board and at least one switch. The display is mounted near the center of the movable cover and is visible from the outside of the counter. The circuit board is mounted under the display. A switch is located on the movable cover corresponding each post.

Other objectives, advantages, and novel features of the invention will become more apparent from the following detailed description when taken in conjunction with the accompanying drawings.

DETAILED DESCRIPTION OF THE PREFERRED EMBODIMFNT

Figure 1:
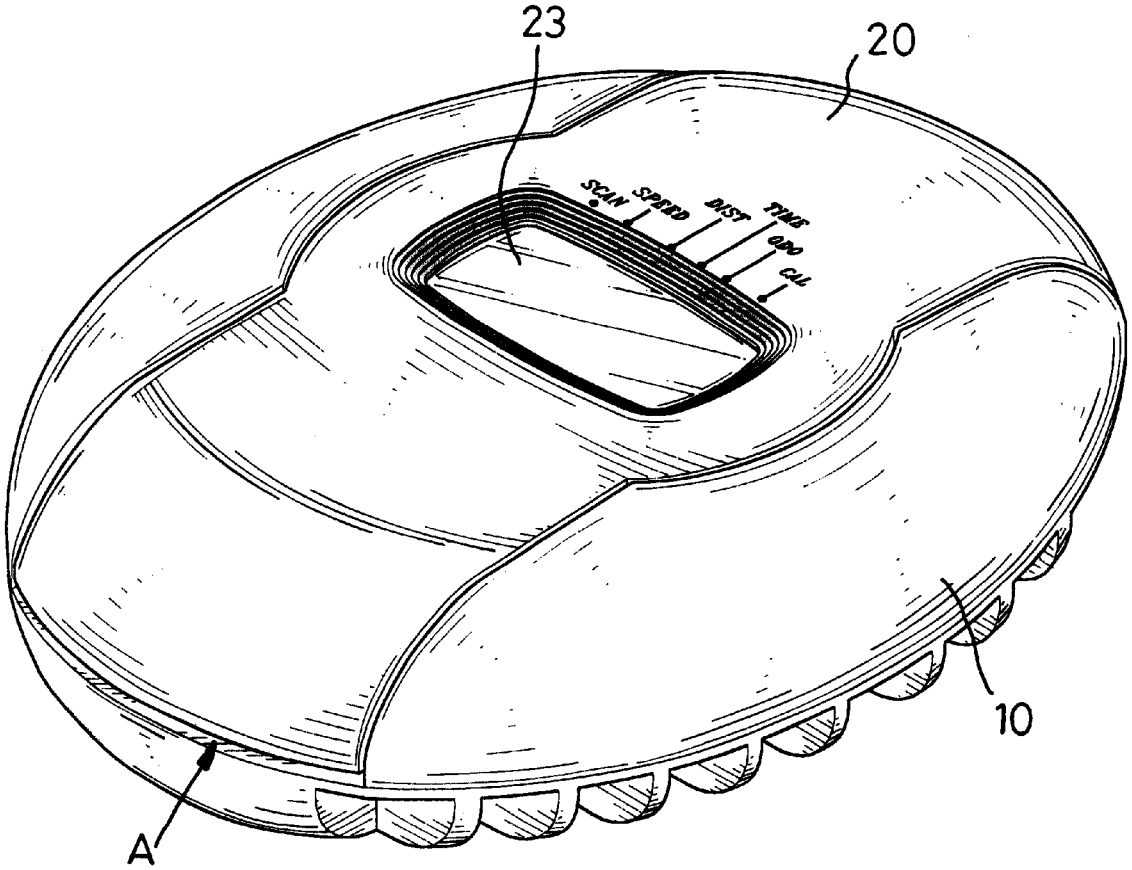
FIG. 1 is a perspective view of the touch counter for an exercise device in accordance with the present invention.
Figure 2:
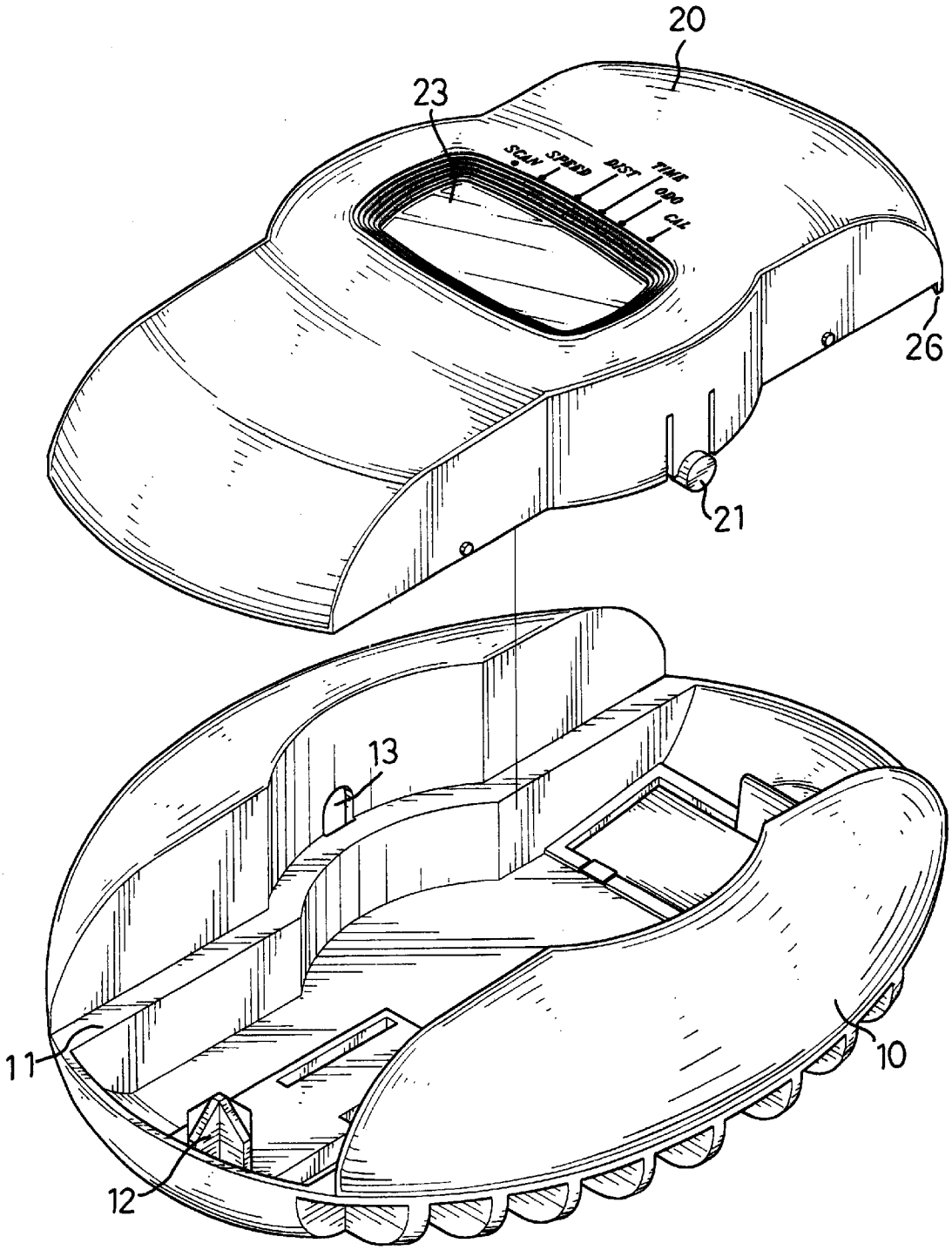
FIG. 2 is an exploded perspective view of the touch counter for an exercise device in FIG. 1.
Figure 3:
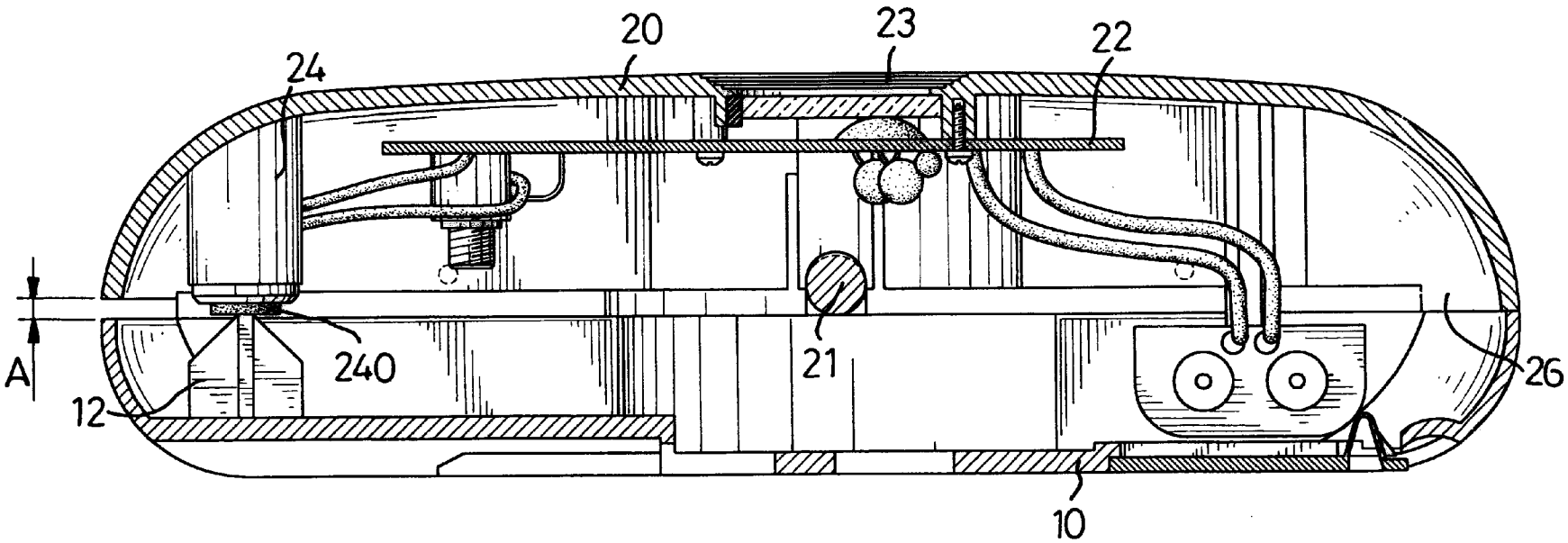
FIG. 3 is a cross sectional side plan view of the touch counter for an exercise device in FIG. 1.

With reference to FIGS. 1, 2 and 3, the touch counter for an exercise device in accordance with the present invention comprises a base (10) and a movable cover (20) pivotally mounted on the base (10).

The base (10) has a cavity (11) defined along the length of the base (10), a post (12) and a pivot holes (13) defined on each sidewalls of the base (10). The post (12) extends upwards from the bottom of the cavity (11).

The movable cover (20) has a pivot pin (21) extending from the middle of each side of the cover (20). The pivot pins (21) correspond to the pivot holes (13) in the base (10). With the pivot pins (21) mounted in the pivot holes (13), a gap (A-A') is formed between the movable cover (20) and the base (10) to allow the movable cover (20) to rock in the gap (A, A'). The display (23) is mounted at a suitable place near the center of the movable cover (20), and a circuit board (22) is mounted under the display (23) to electrically connect to the display (23) and a battery (not numbered) or power source (not shown).

A switch (24) is mounted on the movable cover (20) to correspond to the post (12) in the base (10). A pushbutton (240) mounted on the end of the switch (24) in contact with the post (12, 14) is electrically connected to the power supply (not shown) and the circuit board (22) to control the circuit on the circuit board (22). A lip (26) is formed on the end of the movable cover (20) opposite to the switch (24) and post (12), such that the movable cover (20) will not rock down on the end with the lip (26).

Figure 4:
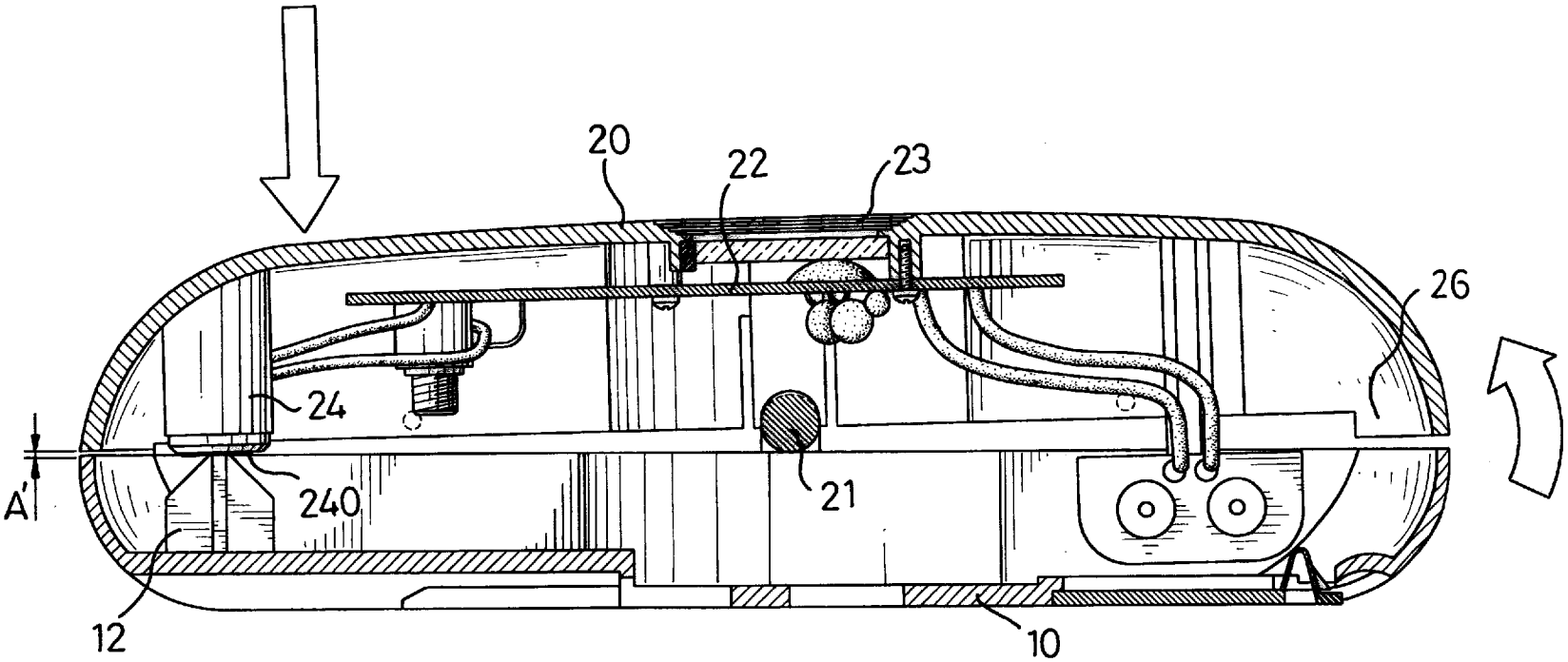
FIG. 4 is an operational cross sectional side plan view of the touch counter for an exercise device in FIG. 1.

With reference to FIG. 4, in operation, the movable cover (20) can rock in the gap (A, A') so that the pushbutton (240) can be alternatively pressed between the post (12) and the switch (24) to show the action information on the display (23).

Figure 5:
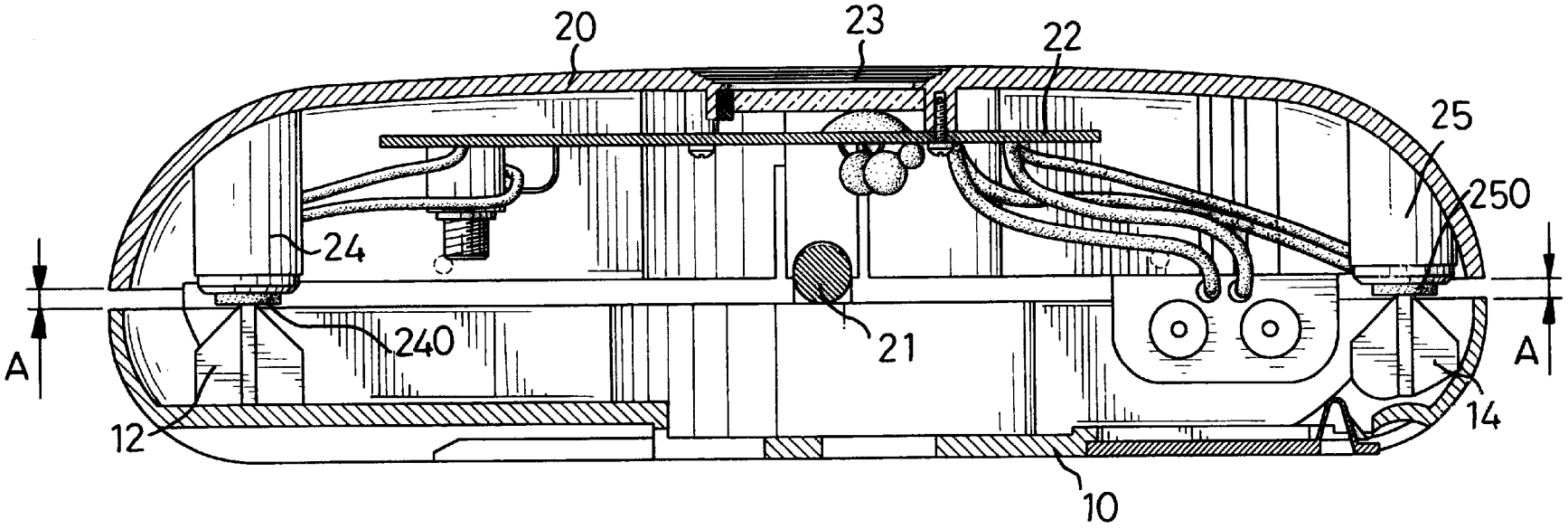
FIG. 5 is a cross sectional side plan view of another embodiment of the touch counter for an exercise device in accordance with the present invention.
Figure 6:
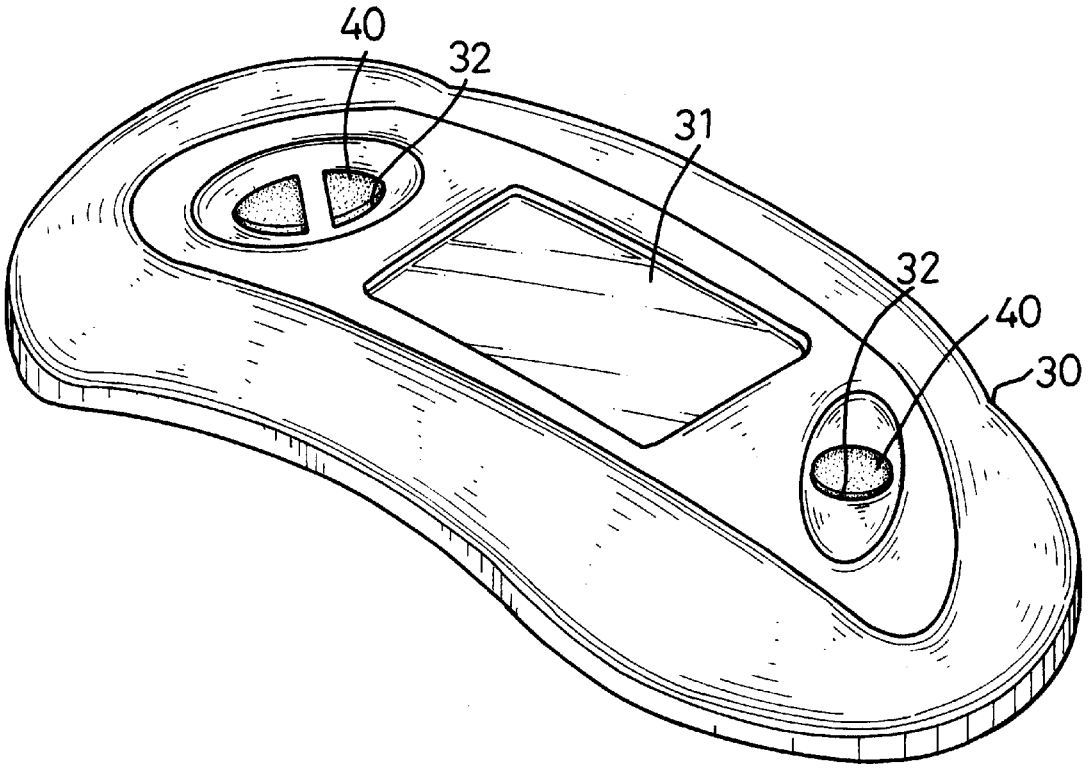
FIG. 6 PRIOR ART
FIG. 6 is a perspective view of a conventional counter for an exercise device.

With reference to FIG. 5, rather than forming a lip (26) on one end of the cover (20), another switch (25) with a pushbutton (250) and posts (14) are mounted near the edge of the movable cover (20) and the base (10). In this configuration, one switch (24) is used to "count" and the other switch (25) is used as a mode or display control.

Although the present invention has been explained in relation to its preferred embodiment, it is to be understood that many other possible modifications and variations can be made without departing from the spirit and scope of the invention as hereinafter claimed.

What is claimed is:

1. A touch counter for an exercise device comprising:

a base having a cavity defined along a length thereof and at least one post extending upwards from a bottom of the cavity;

a movable cover pivotally mounted and contained within the cavity so as to be protected by sidewalls of the cavity and having a display mounted to the cover and visible through a top of the cover;

a circuit board mounted to the cover under the display; and at least one switch electrically connected to the circuit board and extending from under the movable cover, said switch being correspondingly controlled by the post when the movable cover is pressed down.

2. The touch counter for an exercise device as claimed in claim 1, wherein the base has a pivot hole defined on opposite sidewalls in the middle section of the base and the movable cover has a pivot pin corresponding to each pivot hole in the base to allow the pivot pin pass into the pivot holes of the base.

3. The touch counter for an exercise device as claimed in claim 1, wherein a gap (A) is formed between the movable cover and the base to allow the movable cover to rock in the gap (A).

4. The touch counter for an exercise device as claimed in claim 3, wherein a pushbutton is further provided between the post and the switch and electrically connected to a power source and the circuit board.

5. The touch counter for an exercise devise as claimed in claim 1, wherein a lip is further formed on one end of the movable cover, such that when one end of the movable cover moves downwards the other end of the movable cover will move upwards to be limited by the lip.

6. The touch counter for an exercise device as claimed in claim 2, wherein a gap (A) is formed between the movable cover and the base to allow the movable cover to rock in the gap (A).

7. The touch counter for an exercise device as claimed in claim 2, wherein a lip is further formed on one end of the movable cover, such that when one end of the movable cover moves downwards the other end of the movable cover will move upwards to be limited by the lips.

8. The touch counter for an exercise device as claimed in claim 3, wherein a lip is further formed on one end of the moveable cover, such that when one end of the movable cover moves downwards the other end of the movable cover will move upwards to be limited by the lips.

9. The touch counter for an exercise device as claimed in claim 4, wherein a lip is further formed on one end of the movable cover, such that when one end of the movable cover moves downwards the other end of the movable cover will move upwards to be limited by the lips.

* * * * *